United States Patent [19]

Unger

[11] 4,108,065

[45] Aug. 22, 1978

[54] CAN COMPACTOR

[75] Inventor: Harold Victor Unger, Greenville, Ohio

[73] Assignee: Treaty Products Incorporated, Greenville, Ohio

[21] Appl. No.: 754,118

[22] Filed: Dec. 27, 1976

[51] Int. Cl.[2] ..... B30B 15/30

[52] U.S. Cl. ..... 100/215; 100/218; 100/292; 100/DIG. 2

[58] Field of Search ..... 100/49, 215, 216, 218, 100/292, DIG. 2; 221/251, 273; 241/99, 265

[56] References Cited

U.S. PATENT DOCUMENTS

| | | | |
|---|---|---|---|
| 3,204,550 | 9/1965 | Swiderski | 100/245 X |
| 3,659,520 | 5/1972 | Garrett | 100/292 |
| 3,817,169 | 6/1974 | Bischoff | 100/DIG. 2 |
| 3,907,087 | 9/1975 | Tanaka | 100/215 |
| 3,916,780 | 11/1975 | Heiser | 100/DIG. 2 |

*Primary Examiner*—Billy J. Wilhite

*Attorney, Agent, or Firm*—Barnes, Kisselle, Raisch & Choate

[57] ABSTRACT

A can compactor comprising a frame, a generally vertical anvil mounted in the frame, and a ram movable horizontally toward and away from said anvil. A guide is provided for guiding the cans for rolling movement toward the anvil. A stop is provided for a row of cans rolling toward the ram. Upon retraction of the ram a can is forced over the stop into the space between the anvil and the ram where it is retained between the anvil and the ram to permit the ram to be moved and thereby compact the can.

2 Claims, 6 Drawing Figures

CAN COMPACTOR

This invention relates to compactors and particularly to compactors for crushing beverage cans.

BACKGROUND AND SUMMARY OF THE INVENTION

A major ecological and disposal problem confronts commercial establishments which serve beverages in cans. The cans occupy a large volume and necessarily require a substantial amount of handling.

Accordingly among the objects of the invention are to provide a can compactor which will effectively compact cans to a minimum volume; which occupies a small amount of space in the commercial establishment; which can be operated safely by inexperienced personnel; and which is rugged and relatively low in cost.

In accordance with the invention, the can compactor comprises a frame, a generally vertical anvil mounted in the frame and a ram movable horizontally toward and away from the anvil. The cans are guided for rolling movement toward the anvil to a stop. As the ram is retracted, a can is forced over the stop into the space between the anvil and the ram, where it is retained in the space between the anvil and the ram to permit the ram to be moved and thereby compact the can.

DESCRIPTION

Figure 1:
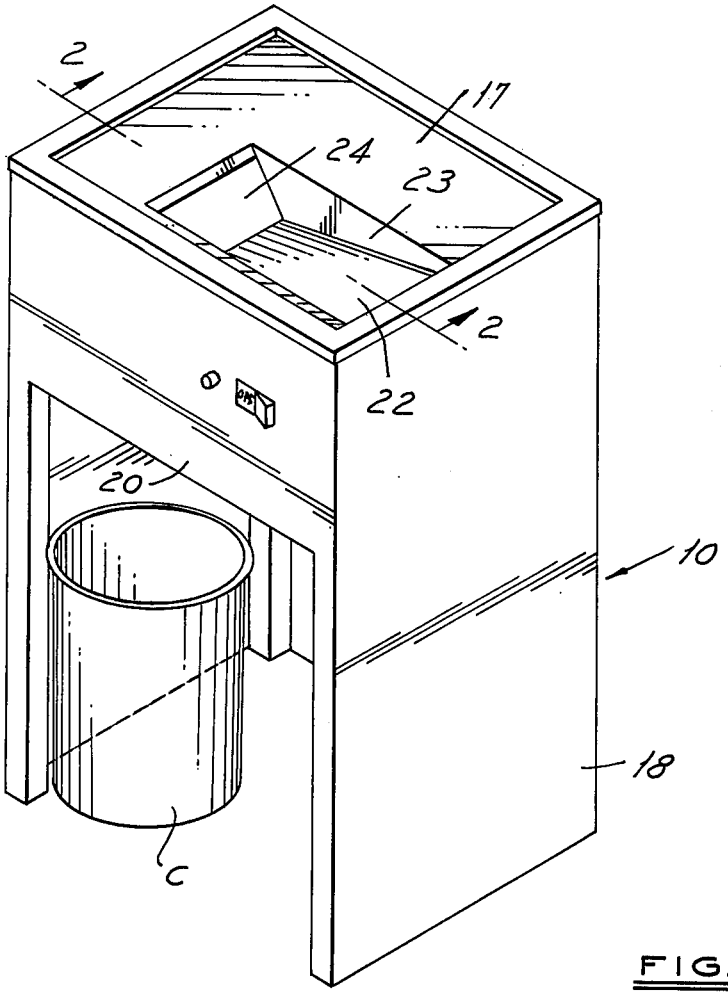
FIG. 1 is a perspective view of a can compactor embodying the invention.
Figure 6:
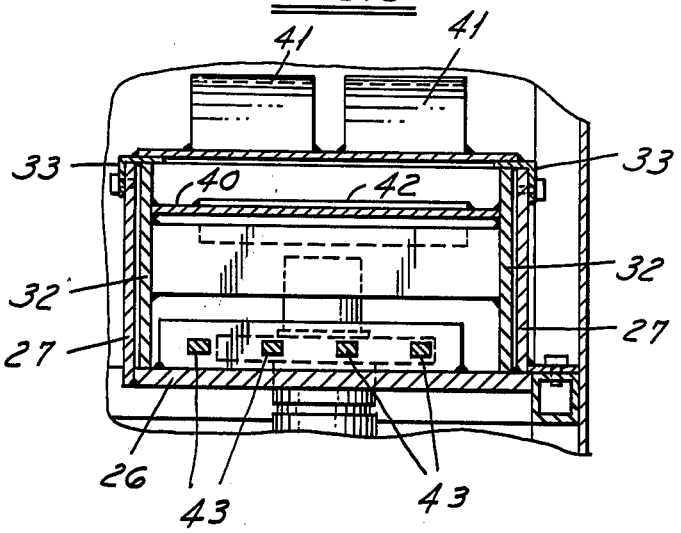
FIG. 6 is a fragmentary sectional view taken along the line 6—6 in FIG. 2.
Figure 2:
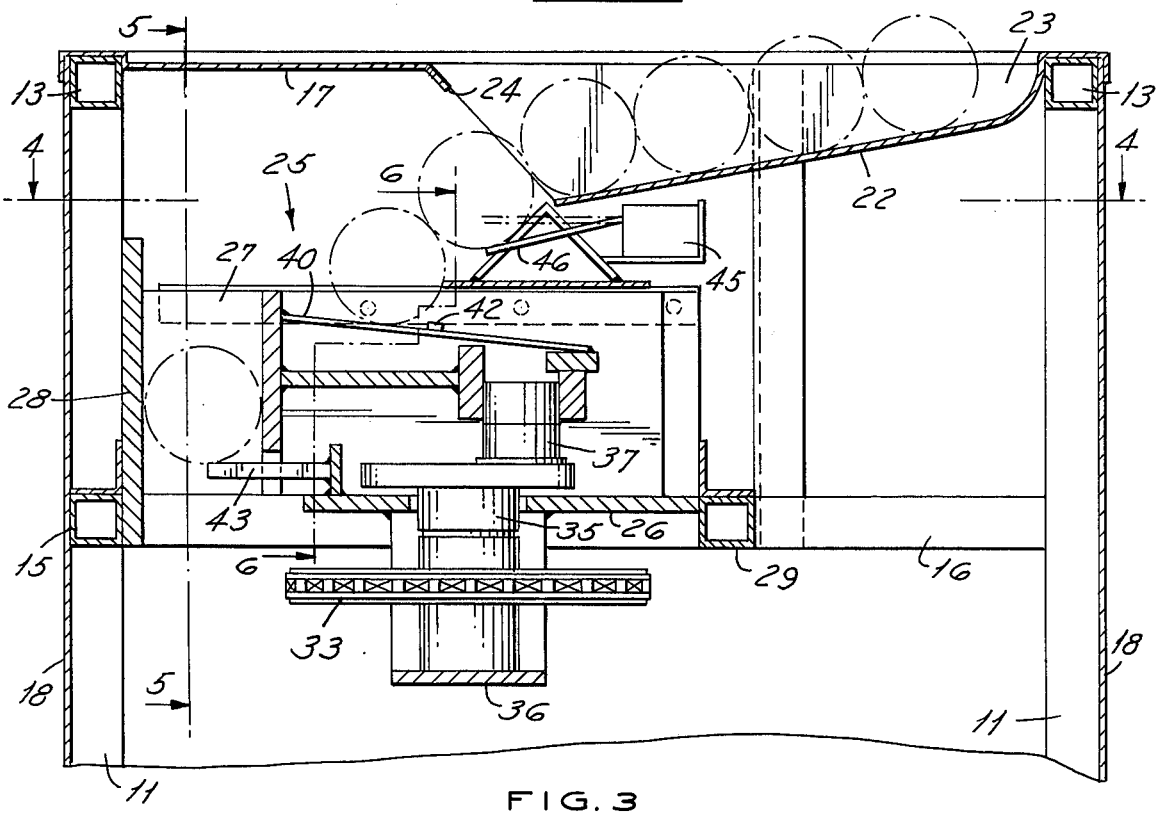
FIG. 2 is a fragmentary sectional view on an enlarged scale taken along the line 2—2 in FIG. 1.
Figure 3:
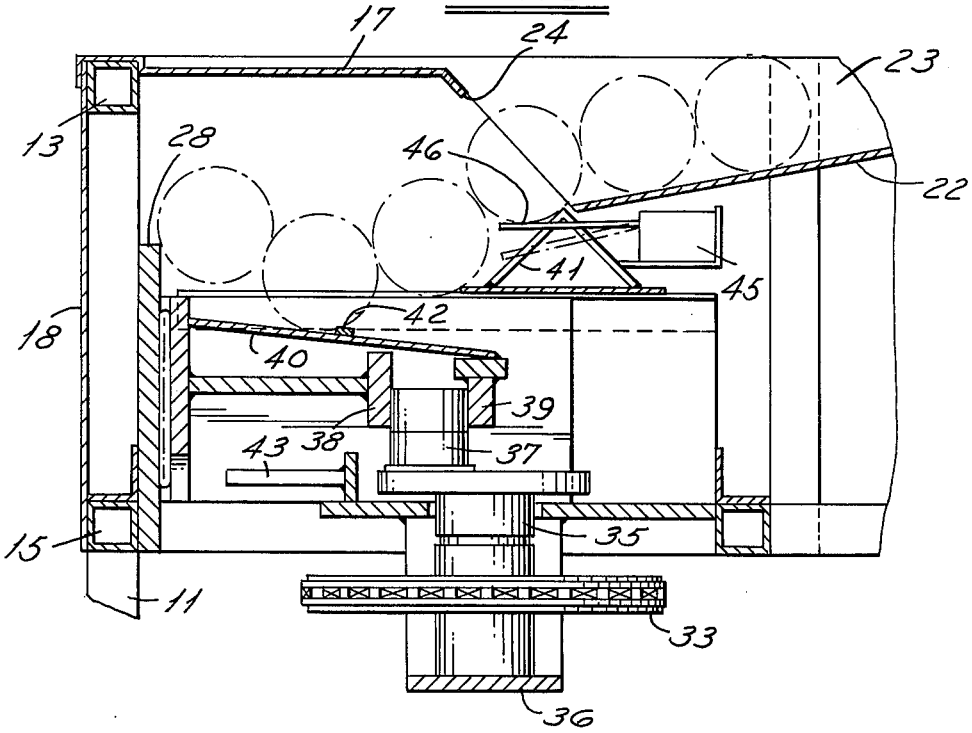
FIG. 3 is a fragmentary sectional view on an enlarged scale of a portion of the compactor shown in FIG. 2 showing the parts in a different operative position.
Figure 4:
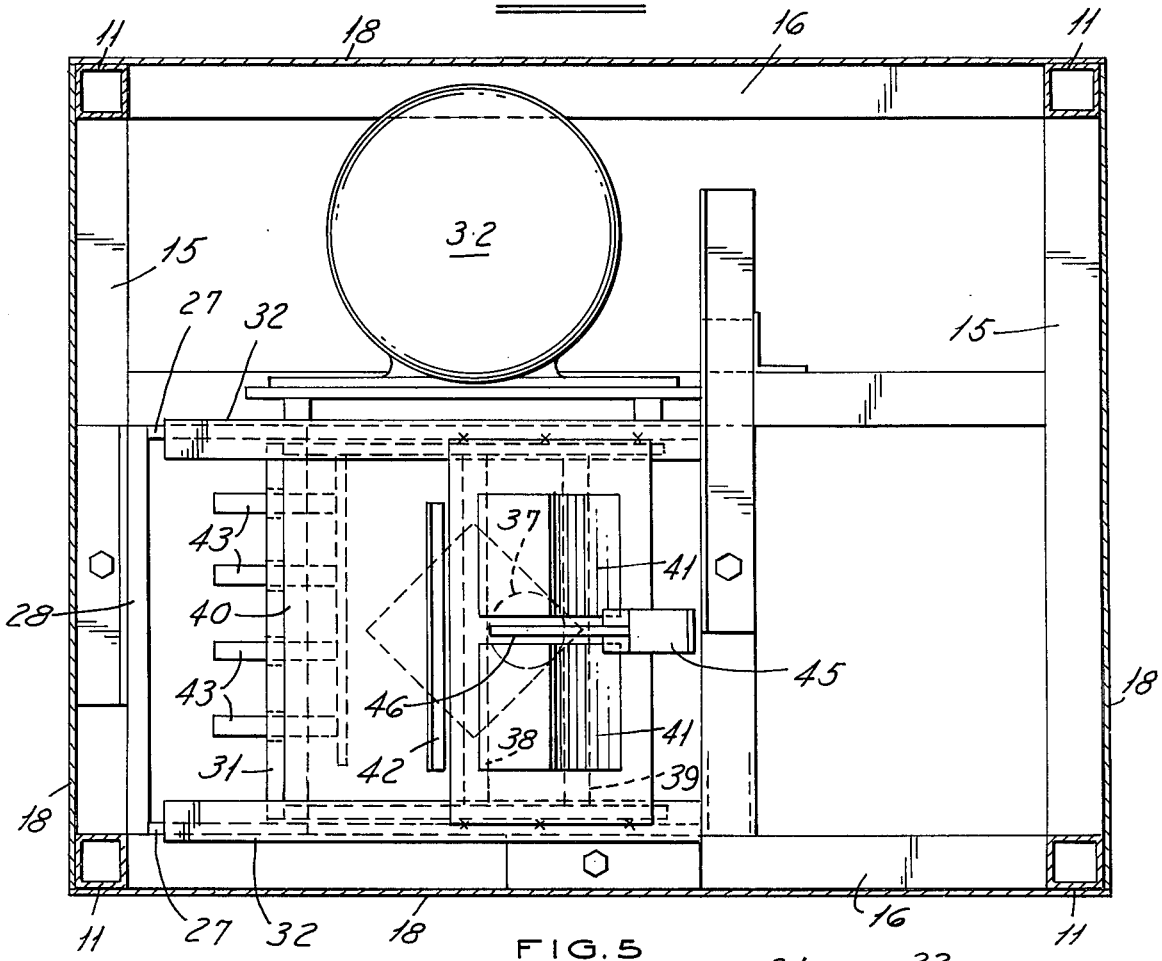
FIG. 4 is a fragmentary sectional view taken along the line 4—4 in FIG. 2.
Figure 5:
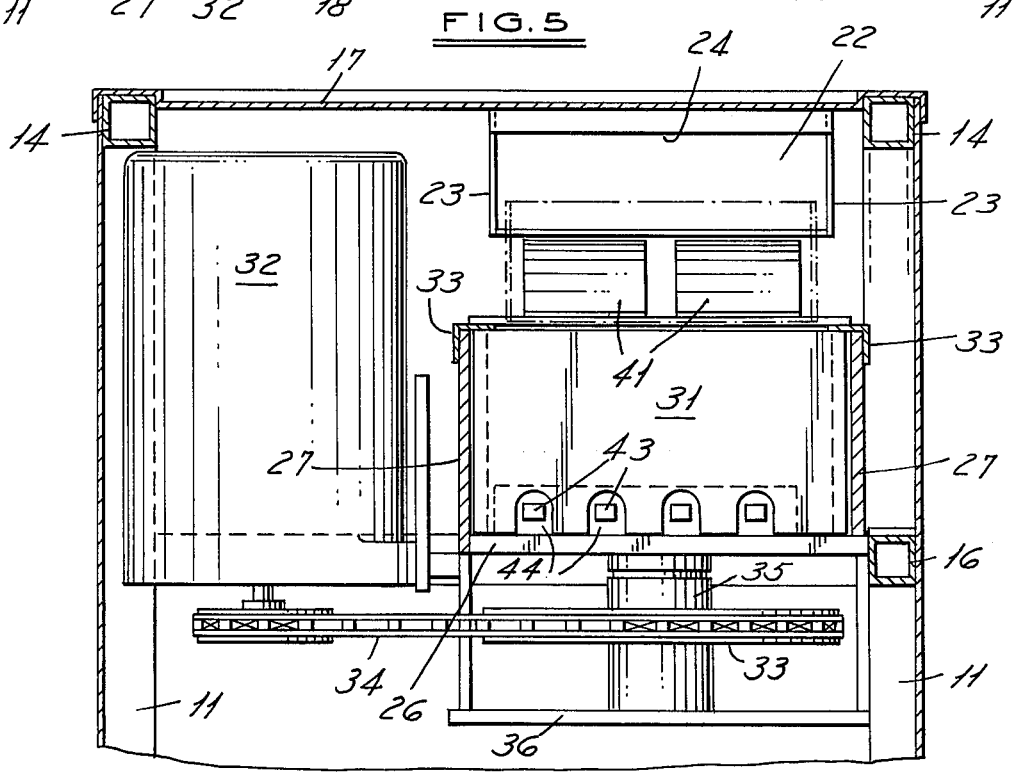
FIG. 5 is a fragmentary sectional view taken along the line 5—5 in FIG. 2.

Referring to FIGS. 1-6, the can compactor 10 embodying the invention comprises a frame including vertical legs 11, upper horizontal members 13, 14 and intermediate horizontal members 15, 16. The compactor includes a top panel 17, side panels 18, a rear panel 19 and a front panel 20 having a lesser height than the side and rear panels to provide access for a container C that receives the compacted cans. The top panel 17 is provided with a recess including a bottom wall 22 and side walls 23, terminating in an opening 24. The cans are delivered manually to the bottom wall 23 and roll downwardly through the opening 24.

A compactor assembly 25 is provided within the cabinet and includes a base plate 26 and upright side plates 27 supporting a vertical anvil plate 28. The base plate 26 is supported between an intermediate horizontal frame member 15 and a transverse member 29.

The compactor assembly 25 further includes a ram comprising a vertical ram plate 31 having side members 32 slidable on the base plate 26 and within the side plates 27. Angles 33 on side plates prevent the side members 32 of the ram from moving upwardly as the ram is reciprocated.

The ram is reciprocated by a drive from a motor 32 which rotates a sprocket 33 through a chain 34, the sprocket being journaled on a shaft 35 mounted between the base plate and a second plate 36.

An eccentric 37 on shaft 35 engages a transverse slot formed by bars 38, 39 extending between the side members of the ram 30.

The ram further includes an inclined plate 40 that has its upper end spaced below the upper edge of the ram plate 31 and extending downwardly and rearwardly. Guides 41 in the form of angularly directed inclined walls are provided across the side plates 27 and guide the cans onto the inclined plate 40 of the ram. The upper edge of the ram plate 31 serves as a stop to prevent forward movement of the leading can. A secondary stop 42 is provided on the plate which combines with the lower edge of the guide to prevent rearward movement of the cans. As the ram is returned from a compacting operation, the engagement of the cans with the lower edge of the guide 41 serves to force the leading can over the upper edge of the ram into the space between the anvil 28 and the ram 31 so that the can can be compacted. Fingers 43 are provided on the base plate and extend forwardly through slots 44 in the lower edge of anvil 31 into spaced relation to the anvil 28 so that the can is prevented from falling downwardly. After the can is compacted, the flattened can can easily pass downwardly to the container C through the space between the ends of the fingers 43 and the anvil 28.

Operation of the motor is initiated by passage of a can over the inclined portion of guide 41 engaging the operating lever 46 of a switch 45 to energize the motor and cause one cycling operation each time the switch is actuated.

I claim:

1. In a can compactor, the combination comprising a frame, a generally vertical anvil mounted in said frame, a base plate, a ram movable horizontally toward and away from said anvil, means for moving said ram toward and away from said anvil, and means for guiding said cans comprising a generally horizontal imperforate top panel having a bottom wall portion inclined downwardly and inwardly from one edge beyond the center of said top panel and terminating in an opening spaced from the ram, said inclined portion guiding cans for rolling movement toward the anvil, means associated with said ram to define a stop for a row of cans rolling toward said ram, said means defining a stop including an inclined top wall extending downwardly and rearwardly from said ram, said top wall terminating below the upper edge of the ram whereby the upper edge of the ram defines said stop, said inclined top wall of said ram including a secondary stop to further prevent rearward movement of the cans along said inclined top wall, and means for retaining the can in the space between said anvil and said ram to permit said ram to be moved and thereby compact the can.

2. In a can compactor, the combination comprising a frame, a generally vertical anvil mounted in said frame, a base plate, a ram movable horizontally toward and away from said anvil, means for moving said ram toward and away from said anvil, and means for guiding said cans comprising a generally horizontal imperforate top panel having a bottom wall portion inclined downwardly and inwardly from one edge beyond the center of said top panel and terminating in an opening spaced from the ram, said inclined portion guiding cans for rolling movement toward the anvil, means associated with said ram to define a stop for a row of cans rolling toward said ram, said means defining a stop including an inclined top wall extending downwardly and rearwardly from said ram, said top wall terminating below the upper edge of the ram whereby the upper edge of the ram defines said stop, and means for retaining the can in the space between said anvil and said ram to permit said ram to be moved and thereby compact the can, a guide extending from adjacent the edge of the inclined portion of said top panel adjacent said opening and cooperating with said stop to force the can over said ram.

* * * * *